US008161666B2

(12) United States Patent
Liles

(10) Patent No.: US 8,161,666 B2
(45) Date of Patent: Apr. 24, 2012

(54) SHOE CONSTRUCTION WITH DOUBLE UPPER

(75) Inventor: Timothy K. Liles, Boston, MA (US)

(73) Assignee: Converse Inc., North Andover, MA (US)

( * ) Notice: Subject to any disclaimer, the term of this patent is extended or adjusted under 35 U.S.C. 154(b) by 767 days.

(21) Appl. No.: 11/536,353

(22) Filed: Sep. 28, 2006

(65) Prior Publication Data

US 2008/0078103 A1 Apr. 3, 2008

(51) Int. Cl.
*A43B 13/14* (2006.01)
*A43C 11/00* (2006.01)

(52) U.S. Cl. ..... 36/99; 36/50.1

(58) Field of Classification Search ..... 36/99, 45, 36/47, 50.1–55
See application file for complete search history.

(56) References Cited

U.S. PATENT DOCUMENTS 1,743,689 A * 1/1930 Scroggins ..... 36/89
1,986,580 A * 1/1935 Johnson ..... 36/89
2,444,428 A * 7/1948 Carrier ..... 36/99
2,531,763 A * 11/1950 Andre ..... 36/117.8
D173,030 S * 9/1954 Hoza ..... D2/902
3,837,098 A 9/1974 Rathmell
4,571,856 A * 2/1986 Lin et al. ..... 36/89
5,909,947 A * 6/1999 DeMarchi ..... 36/50.5
7,086,181 B2 8/2006 Farys

OTHER PUBLICATIONS

International Search Report dated Mar. 26, 2008 for PCT/US2007/079558, pp. 1-3.

* cited by examiner

*Primary Examiner* — Jila Mohandesi
*Assistant Examiner* — Melissa Lalli
(74) *Attorney, Agent, or Firm* — Shook Hardy & Bacon LLP

(57) ABSTRACT

A novel shoe construction provides a unique aesthetically pleasing appearance to a shoe while also reinforcing the shoe construction. In the shoe construction, the shoe is provided with a first upper that extends upwardly from the shoe sole and is secured around a wearer's foot by adjustable fasteners such as lacing, and a second upper that extends upwardly from the shoe sole and is separate from and overlaps the first upper on opposite sides of the shoe and at the rear of the shoe.

22 Claims, 3 Drawing Sheets

SHOE CONSTRUCTION WITH DOUBLE UPPER

BACKGROUND OF THE INVENTION (1) Field of the Invention

The present invention pertains to a novel shoe construction that provides a unique aesthetically pleasing appearance to a shoe while also reinforcing the shoe construction. In particular, the present invention pertains to a shoe construction in which the shoe is provided with a first upper that extends upwardly from the shoe sole and is secured around a wearer's foot by adjustable fasteners such as lacing, and a second upper that extends upwardly from the shoe sole and overlaps the first upper on opposite sides of the shoe and at the rear of the shoe.

(2) Description of the Related Art

The oxford lace-up basketball shoe has been a very popular shoe for athletics for many years. In more recent years, in addition to the use of the shoe in athletics, the shoe has also become very popular as a comfortable casual shoe that has an aesthetically pleasing appearance. Shoes of this type are known as athleisure shoes. This is particularly true of the oxford lace-up basketball shoe that has an upper constructed of a flexible, breathable fabric, for example canvas.

With the increasing popularity of the oxford basketball shoe or athleisure shoes in general, new appearances have been sought for the shoe to maintain the marketability of the shoe by keeping up with the latest trends in fashion. However, in order to maintain the comfortable construction of the oxford-type shoe, changes to the shoe to keep up with fashion trends have been limited to changes in the color or pattern of the fabric employed in manufacturing the shoe. However, the colors or patterns of material employed in constructing the shoe are limited, creating a need to provide a new and aesthetically pleasing appearance of the shoe without detracting from the comfortable construction of the shoe.

SUMMARY OF THE INVENTION

The present invention overcomes the problem of providing a new and aesthetically pleasing appearance of an oxford lace-up basketball shoe without detracting from the comfortable construction of the shoe, and while actually reinforcing the construction of the shoe. The invention provides a novel modification to the shoe construction without substantially changing the original shoe construction. The athleisure shoe of the invention has basically the same construction as the popular oxford lace-up basketball shoe, but with an additional outer upper layer that overlaps the traditional upper of the shoe and provides a new, aesthetically pleasing appearance for the shoe.

The shoe construction of the present invention has a shoe sole that is substantially the same as the shoe sole employed in the construction of a typical athleisure shoe, for example a basketball oxford. The shoe construction of the invention also includes an upper that extends upwardly from the shoe sole to a top edge of the upper that defines a forefoot opening of the shoe and an ankle opening of the shoe that provide access to the shoe interior for the shoe wearer's foot. A tongue also extends upwardly through the forefoot opening. An adjustable fastener, preferably lacing, extends across the forefoot opening and adjustably secures together the opposite sides of the upper over the shoe wearer's foot by tightening and tying the lacing, all of which are conventional.

The novel construction of the shoe of the invention is provided by a second, outer upper that extends upwardly from the shoe sole. The second upper extends upwardly over the opposite left and right side portions of the inner upper, and upwardly over the rear portion of the inner upper. The outer, second upper has basically the same configuration as the first, inner upper, but does not extend upwardly from the sole to the same extent as the inner upper. This exposes a portion of the first, inner upper above the top edge of the outer upper. In addition, the second, outer upper is left unattached to the first, inner upper, except for the connections of the two overlapping uppers at the shoe sole. The second, outer upper is provided with lacing eyelets in the same manner as the first, inner upper, but the lacing does not extend through the eyelets of the second upper and only extends through the eyelets of the first upper.

Thus, the shoe construction with the double, overlapping uppers gives the shoe a novel aesthetically pleasing appearance without detracting from the comfortable construction of the shoe. Furthermore, by providing the second, outer upper overlapping the first, inner upper, the shoe construction is reinforced by the double overlapping layers of the upper.

BRIEF DESCRIPTION OF THE DRAWINGS

Further features of the invention are set forth in the following detailed description of the preferred embodiment of the invention and in the drawing figures.

DETAILED DESCRIPTION OF THE PREFERRED EMBODIMENT

Figure 1:
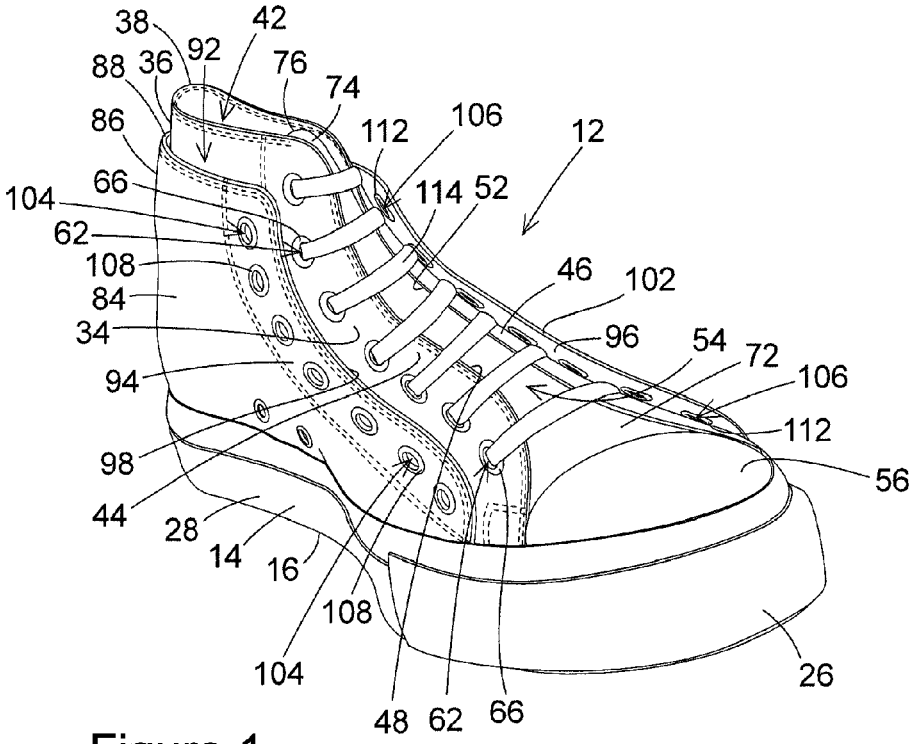
FIG. 1 is a perspective view of the front of a left shoe of the invention, with the right shoe of the invention having a construction that is a mirror image duplicate of the left shoe construction.
Figure 2:
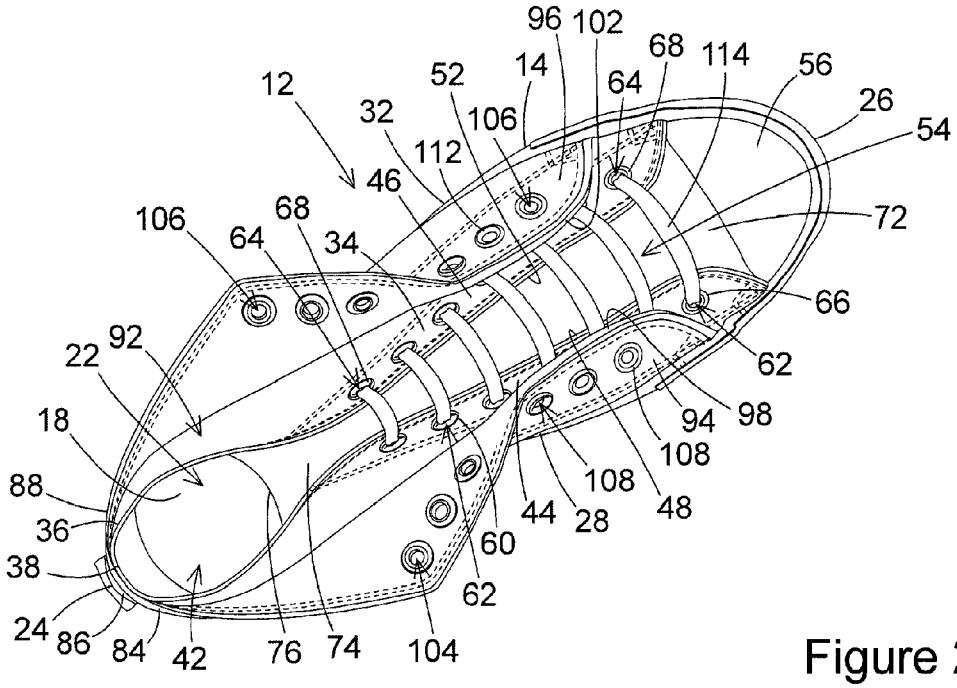
FIG. 2 is a top plan view of the shoe shown in FIG. 1.
Figure 3:
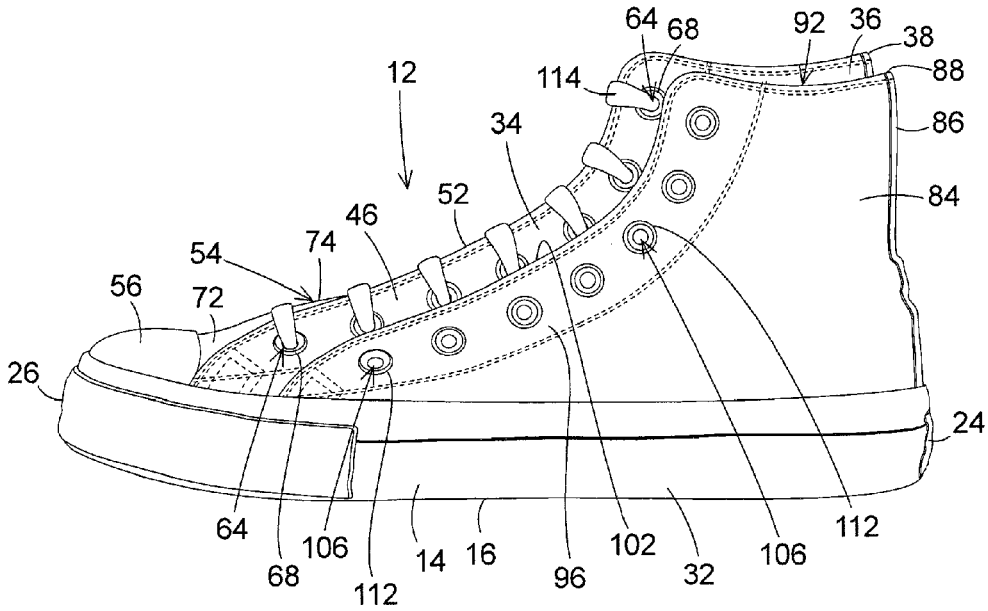
FIG. 3 is a left side elevation view of the shoe shown in FIG. 1.
Figure 4:
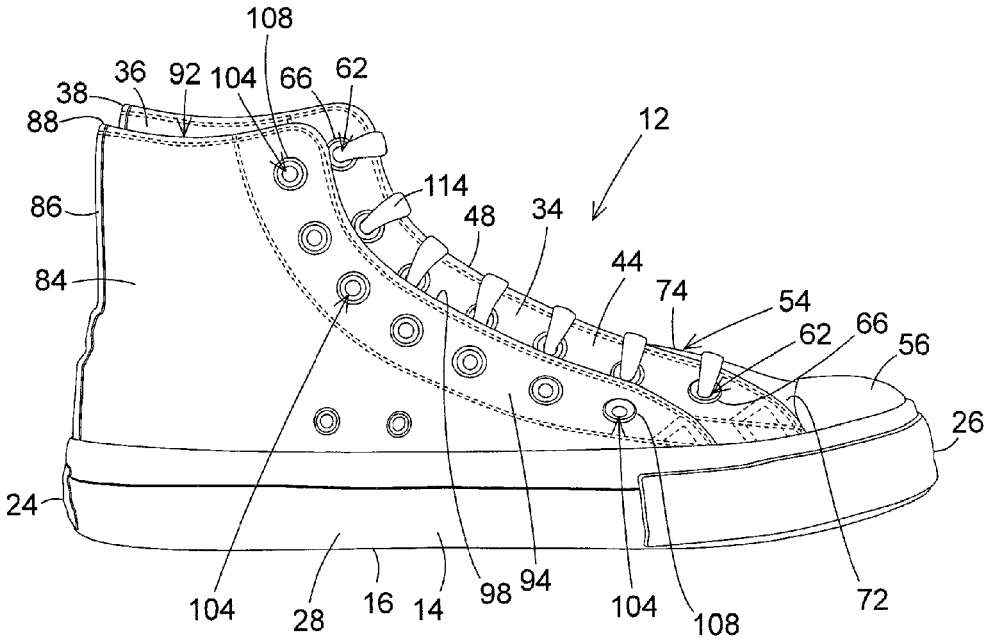
FIG. 4 is a right side elevation view of the shoe shown in FIG. 1.
Figure 5:
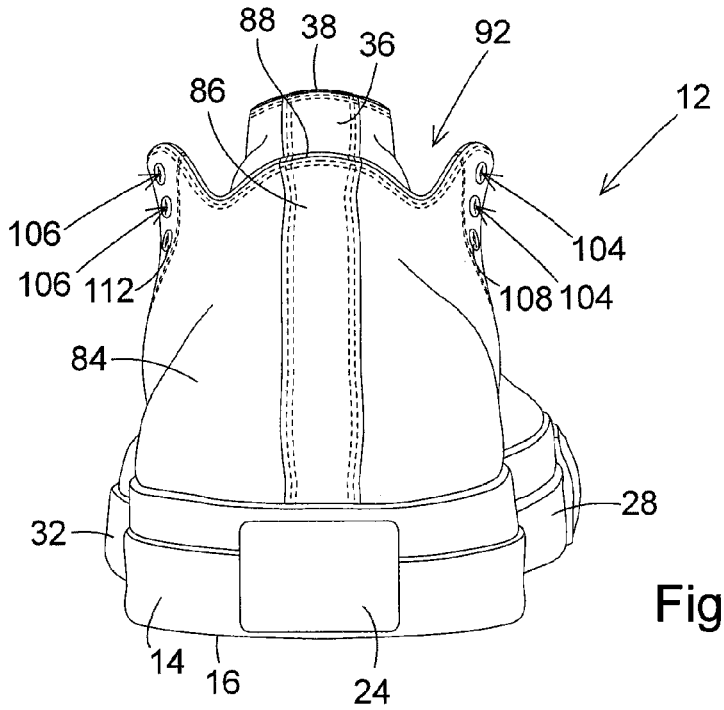
FIG. 5 is a rear elevation view of the shoe shown in FIG. 1.
Figure 6:
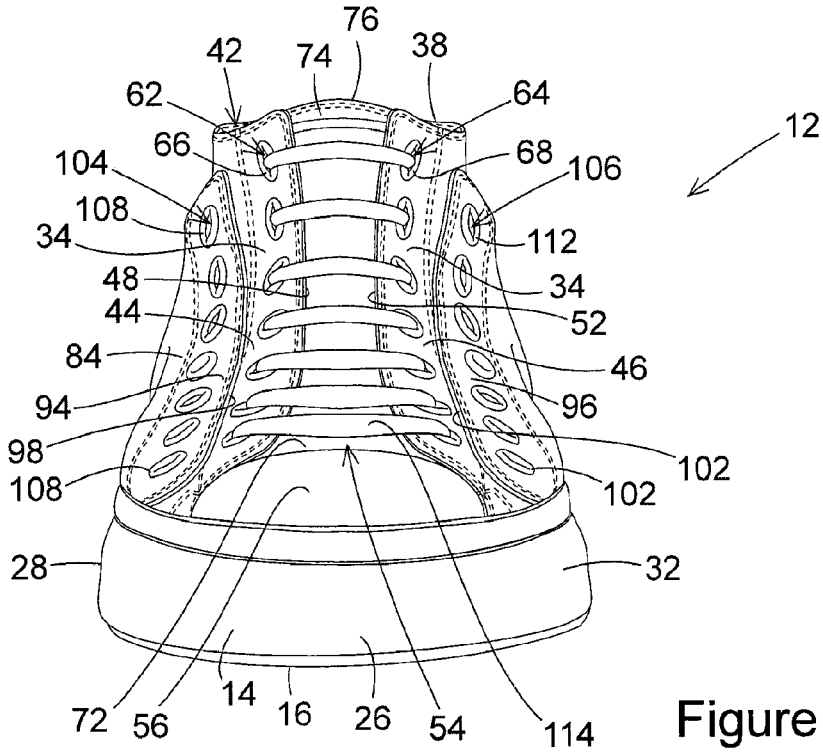
FIG. 6 is a front elevation view of the shoe shown in FIG. 1.

The double upper construction of the athleisure shoe 12 of the present invention has the basic construction of an oxford lace-up basketball shoe. The exception is that the novel construction of the shoe 12 provides the shoe with a second, outer upper that is separate from the first, inner upper of the shoe. This provides the shoe with a unique, aesthetic appearance, and reinforces the shoe by providing a double layer of flexible material on the shoe upper. In the preferred embodiment of the shoe 12 shown in the drawing figures, the shoe is a high-top oxford basketball shoe. However, it should be understood that the novel concept of the invention could be employed on other types of shoes. Because much of the construction of the shoe 12 of the invention is the same as that of a conventional oxford lace-up shoe, the conventional features of the construction will be described only generally herein.

The shoe 12 has a shoe sole 14 that is constructed of resilient materials that are typically employed in the construction of soles of athletic shoes. The sole 14 can be constructed with an outsole, a midsole, and an insert, as is conventional. The shoe sole 14 has a bottom surface 16 that functions as the traction surface of the shoe, and an opposite top surface 18 in the interior 22 of the shoe. The size of the shoe 12 has a length that extends from a rear heel end 24 to a front toe end 26 of the sole, and the shoe 12 has a width that extends between a right side 28 and a left side 32 of the shoe sole.

The shoe upper 32 is secured to the shoe sole 14 and extends upwardly from the shoe sole top surface 18, as is conventional. The upper 34 is constructed of a flexible material, for example leather or a fabric such as canvas. The upper 34 is constructed with a heel portion 36 that extends around the shoe sole top surface 18 at the shoe sole heel end 24. The upper heel portion 36 extends upwardly from the shoe sole 18 to a collar edge 38 of the upper that defines an ankle opening 42 into the shoe interior 22.

From the heel portion 36, the upper 34 has a right side portion 44 and a left side portion 46 that extend forwardly along the respective shoe sole right side 28 and shoe sole left side 32. The upper right side portion 44 extends upwardly from the shoe sole right side 28 to an upper right side edge 48. The upper left side portion 46 extends upwardly from the shoe sole left side 32 to an upper left side edge 52. As seen in the drawing figures, the upper right side edge 48 and the upper left side edge 52 extend forwardly from opposite sides of the upper collar edge 38 toward the front toe end 26 of the shoe sole. The length of the upper right side edge 48 and the upper left side edge 52 define a forefoot opening 54 in the shoe upper 34 that opens to the shoe interior 22.

The upper 34 is also constructed with a toe box or toe cap 56 that extends around and across the shoe sole top-surface 18 at the shoe sole toe end 26. The toe box 56 is connected between the upper right side portion 44 and the upper left side portion 46 and encloses a portion of the shoe interior 22 adjacent the shoe sole toe end 26. The upper right side edge 48 and the upper left side edge 52 extend rearwardly from the toe box 56.

A first plurality of apertures 62 are provided on the upper right side portion 44 and a second plurality of apertures 64 are provided on the upper left side portion 46. The apertures 62, 64 are preferably lacing openings, meaning openings on the shoe upper that are typically occupied by a portion of the lacing that closes the shoe upper over the forefoot opening of the shoe. The apertures 62, 64 can be provided by any known means of providing lacing openings on shoes, for example D-rings or speed lacing hooks. However, in the preferred embodiment of the invention, the apertures 62, 64 are provided by a first plurality of eyelets or grommets 66 on the upper right side portion 44 and a second plurality of eyelets or grommets 68 on the upper left side portion 46. The eyelets 66, 68 provide the desired conventional lace-up shoe appearance. The apertures 62, 68 are arranged in lines along the upper right side edge 48 and along the upper left side edge 52 of the shoe upper, as is conventional. As is seen in the drawing figures, the apertures 62, 64 extend substantially the entire lengths of the upper right side edge 48 and the upper left side edge 52 between the upper collar edge 48 and the upper toe box 56.

The shoe upper 34 includes a vamp 72 or throat positioned rearwardly of the toe box 56, and a tongue 74 that extends rearwardly from the vamp 72 through the forefoot opening 54. The tongue 74 extends along the lengths of the upper right side portion 44 and the upper left side portion 46 to a distal end 76 of the tongue. The tongue 74 has a width between a right side edge (not shown) and a left side edge (not shown) of the tongue. The length and width of the tongue position the tongue side edges beneath the upper right side portion 44 and the upper left side portion 46, respectively, and extend the tongue over the forefoot opening 54 of the shoe.

The construction of the shoe 12 to this point has been, for the most part, conventional. The unique shoe construction of the invention is provided by a second, outer shoe upper 84 that is also secured to the shoe sole 14 and extends upwardly from the shoe sole top surface 18 over the exterior of the first, inner shoe upper 34. The second upper 84 is constructed of a flexible material, for example leather or fabric. To improve the appearance of the shoe 12, the second upper 84 can be constructed of a material having a different visual appearance than the first upper 34, for example having a different color. The second upper 84 is also constructed with a heel portion 86 that extends around the shoe sole top surface 18 at the shoe sole heel end 24. The second upper heel portion 86 extends upwardly from the shoe sole 14 to a collar edge 88 of the second upper that surrounds the collar edge 38 of the first upper 34, but is separate from and is spaced from the collar edge 38 of the first upper 34. As seen in the drawing figures, the second upper 84 does not extend upwardly from the shoe sole 14 to the same extent as the first upper 34, resulting in the first upper 34 extending upwardly beyond the second upper 84. Thus, the second upper collar edge 88 defines a second ankle opening 92 that contains the first upper heel portion 36.

From the second upper heel portion 86, the second upper has a right side portion 94 and a left side portion 96 that extend forwardly along the respective shoe sole right side 28 and shoe sole left side 32. The second upper right side portion 94 extends over and overlaps the first upper right side portion 44 and extends upwardly from the shoe sole right side 28 to an upper right side edge 98 of the second upper. As seen in the drawing figures, the second upper does not extend upwardly from the shoe sole to the same extent as the first upper, therefore, the second upper right side edge 98 is separate from and spaced below the first upper right side edge 48. The second upper left side 96 extends upwardly from the shoe sole left side 32 to a second upper left side edge 102. The second upper left side edge 102 is also separate and spaced from the first upper left side edge 52.

The second upper right side and left side edges 98, 102 have basically the same configurations and extend along the first upper right side and left side edges 48, 52, but are spaced below the first upper edges. Thus, the first upper 34 of the shoe 12 projects upwardly beyond the top edges of the second upper 84, allowing portions of the first upper 34 to be seen above the second upper 84. In the preferred embodiment of the invention, the second upper 84 extends over a majority of the exterior of the first upper 34, but is separate from the first upper 34 and can be pulled away or folded downwardly from the first upper 34 to expose more of the first upper 34. The first upper 34 and the second upper 84 are basically attached to each other only where the two uppers are attached to the shoe sole 14.

A third plurality of apertures 104 and a fourth plurality of apertures 106 are provided on the respective second upper right side portion 94 and second upper left side portion 96. The apertures 104, 106 are basically the same type of apertures 62, 64 described earlier in the description of the construction of the first upper 34. That is, the third plurality of apertures 104 is provided by a third plurality of eyelets 108 on the second upper right side portion 94 and the fourth plurality of apertures 106 is provided by a fourth plurality of eyelets 112 on the second upper left side portion 96. The eyelets 108, 112 are arranged in a line adjacent to the second upper right side edge 98 and the second upper left side edge 102, just as on the earlier described first upper 34. However, there is no lacing or other adjustable fasteners connecting the third plurality of eyelets 108 with the fourth plurality of eyelets 112.

In the preferred embodiment of the invention, the adjustable fasteners that extend between the first upper right side portion 44 and the first upper left side portion 46 is shoe lacing 114, However, other equivalent fasteners known in the art and used with shoes, for example elastic bands or hook and loop-type straps, may also be used. In the shoe construction of the invention, the lacing 114 only extends through the first plurality of eyelets 66 on the first upper right side portion 44 and the second plurality of eyelets 68 on the first upper left side portion 46. The drawing figures show the lacing 114 extending through all of the eyelets 66, 68 and extending across the forefoot opening 54. In alternate embodiments, fewer than all of the eyelets 66, 68 on the respective right side portion 44 and left side portion 46 of the first upper 34 may receive a portion of the lacing 114.

There is no lacing that extends through the eyelets 108 on the second upper right side portion 94 and the eyelets 112 on the second upper left side portion 96. The absence of the lacing through the eyelets of the second upper 84 gives the shoe 12 a unique appearance.

Although the shoe of the invention has been described above by referring to a particular embodiment of the shoe, it should be understood that the modifications and variations could be made to the shoe described without departing from the intended scope of protection provided by the following claims.

The invention claimed is:

1. A shoe construction comprising:

a sole having a sole toe end and an opposite sole heel end and having opposite sole right and sole left sides extending between the toe end and sole heel end;

a first upper of flexible material attached to the sole, the first upper extending upwardly from the sole to a top edge of the first upper, the first upper extends upwardly from the sole continuously along the sole right side, the sole heel end, and the sole left side, the first upper top edge defining a forefoot opening and an ankle opening into an interior of the shoe inside the first upper;

a toe box attached to the sole and extending around and across the sole toe end, the toe box is directly attached to a first upper right side portion and a first upper left side portion of the first upper;

a tongue portion directly attached to a vamp, the vamp directly attached to the toe box;

a second upper of flexible material attached proximate to the sole, the second upper extending upwardly from the sole to a top edge of the second upper that is separate and spaced from the top edge of the first upper and the second upper extends continuously along the sole right side, the sole heel end, and the sole left side, the second upper top edge extending around the forefoot opening and the ankle opening second upper overlapping and surrounding the first upper the first upper extending upwardly from the shoe sole beyond the second upper at the ankle opening.

2. The shoe construction of claim 1, further comprising:

at least one adjustable fastener extending across the forefoot opening and connecting only the first upper extending along the sole right side with only the first upper extending along the sole left side.

3. The shoe construction of claim 2, further comprising:

the second upper being separate from and not connected with the at least one adjustable fastener.

4. The shoe construction of claim 2, further comprising:

the at least one adjustable fastener being lacing that extends across the forefoot opening and interconnects the first upper extending along the sole right side and the first upper extending along the sole left side.

5. The shoe construction of claim 4, further comprising:

a first plurality of lacing apertures on the first upper on one side of the forefoot opening and a second plurality of lacing apertures on the first upper on an opposite side of the forefoot opening from the first plurality of lacing apertures; and, a third plurality of lacing apertures on the second upper on one side of the forefoot opening and a fourth plurality of lacing apertures on the second upper on an opposite side of the forefoot opening from the third plurality of lacing apertures.

6. The shoe construction of claim 5, comprising:

the lacing extending through lacing apertures of the first and second pluralities of apertures and not extending through apertures of the third and fourth pluralities of apertures.

7. The shoe construction of claim 1, further comprising:

the second upper overlapping a majority of the first upper.

8. The shoe construction of claim 1, further comprising:

the second upper top edge being unattached to the first upper.

9. The shoe construction of claim 1, further comprising:

the first upper and the second upper being constructed of a same flexible material.

10. The shoe construction of claim 1, further comprising:

the flexible material of the first upper having a different visual appearance than the flexible material of the second upper.

11. A shoe construction comprising:

a sole having a toe end and an opposite sole heel end and having opposite sole right and sole left sides extending between the toe end and the sole heel end;

a first upper of flexible material attached to the sole and extending upwardly from the sole continuously along the sole right side, the sole heel end, and the sole left side, the first upper having a forefoot opening between portions of the first upper that extend upwardly from the sole right side and the sole left side and the first upper having an ankle opening between portions of the first upper that extend upwardly from the sole right side, the sole heel end, and the sole left side;

a toe box attached to the sole and extending around and across the sole toe end, the toe box directly attached to the first upper proximate a first upper right side portion and proximate a first upper left side portion of the first upper;

a tongue portion attached to the toe box;

a second upper of flexible material attached proximate to the sole and extending upwardly from the sole continuously along the sole right side, the sole heel end, and the sole left side, the second upper overlapping and surrounding the first upper;

the first upper extending upwardly from the shoe sole beyond the second upper at the ankle opening;

along the sole right side, the first upper extending further toewardly to the sole toe end than the second upper;

a first plurality of apertures only on the first upper on one side of the forefoot opening and a second plurality of apertures only on the first upper on an opposite side of the forefoot opening from the first plurality of apertures, the first plurality of apertures and the second plurality of apertures extend along a length from a collar edge of the first upper to the toe box; and, a third plurality of apertures only on the second upper on the one side of the forefoot opening and a fourth plurality of apertures only on the second upper on the opposite side of the forefoot opening from the third plurality of apertures.

12. The shoe construction of claim 11, further comprising:

at least one adjustable fastener extending across the forefoot opening and interconnecting apertures of only the first and second pluralities of apertures.

13. The shoe construction of claim 11, further comprising:

at least one lace extending across the forefoot opening and through apertures of only the first and second pluralities of apertures.

14. The shoe construction of claim 11, further comprising:

the second upper overlapping a majority of the first upper.

15. The shoe construction of claim 11, further comprising:

a top edge of the second upper being unattached to the first upper.

16. The shoe construction of claim 11, further comprising:

the flexible material of the first upper having a different visual appearance than the flexible material of the second upper.

17. A shoe construction comprising:

a shoe sole having a sole toe end, a sole right side, a sole heal end, and a sole left side;

a first upper attached to the shoe sole and extending upwardly from the shoe sole, the first upper having a first right side portion and a first left side portion that are dimensioned to cover over respective right and left sides of a shoe wearer's foot, and a first rear portion that is dimensioned to cover over a heel of the shoe wearer's foot, the first right side portion and the first left side portion having edges that define a first forefoot opening of the first upper between the edges of the first right side and first left side portions, and the first rear portion having an edge that with the edges of the first right side and first left side portions define an ankle opening of the first upper surrounded by the first right side portion edge, the first rear portion edge, and the first left side portion edge;

the first right side portion, the first rear portion, and the first left portion extending continuously along the sole from the sole right side around the sole heel end to the sole left side;

a toe box attached to the shoe sole and extending around and across a shoe sole toe end, the toe box directly attached to the first upper proximate the first right side portion and directly attached to the first upper proximate the first left side portion;

a tongue portion directly attached to a vamp, the vamp directly attached to the toe box;

a second upper attached proximate to the shoe sole and extending upwardly from the shoe sole and overlapping the first upper, the second upper having a second right side portion and a second left side portion that overlap and are separate from the respective first right side portion and first left side portion of the first upper, the first right side portion of the first upper extends more toewardly along the sole than the second right side portion of the second upper, and the second upper having a second rear portion that overlaps and is separate from the first rear portion of the first upper;

the second right side portion, the second rear portion, and the second left portion extending continuously along the sole from the sole right edge around the sole heel end to the sole left edge; and the first upper extending upwardly from the shoe sole beyond the second upper at the ankle opening.

18. The shoe construction of claim 17, further comprising:

the second upper overlapping a majority of the first upper.

19. The shoe construction of claim 17, further comprising:

at least one adjustable fastener extending across the forefoot opening and interconnecting only the first right side portion and the first left side portion of the first upper.

20. The shoe construction of claim 17, further comprising:

a first plurality of lacing apertures on the first upper on one side of the forefoot opening and a second plurality of lacing apertures on the first upper on an opposite side of the forefoot opening from the first plurality of lacing apertures; and, a third plurality of lacing apertures on the second upper on one side of the forefoot opening and a fourth plurality of lacing apertures on the second upper on an opposite side of the forefoot opening from the third plurality of lacing apertures.

21. The shoe construction of claim 20, further comprising:

a lacing extending through lacing apertures of the first and second pluralities of apertures and not extending through apertures of the third and fourth pluralities of apertures.

22. The shoe construction of claim 17, further comprising:

the first upper having a different visual appearance than the second upper.

* * * * *